United States Patent [19]

Micheletti

[11] 4,369,637

[45] Jan. 25, 1983

[54] CIRCULAR KNITTING MACHINES

[76] Inventor: Arrigo Micheletti, Viale Papa Giovanni XXIII°, No. 3, Fucecchio, Firenze, Italy

[21] Appl. No.: 165,698

[22] Filed: Jul. 3, 1980

[30] Foreign Application Priority Data

Jul. 9, 1979 [IT] Italy ..... 11726/79[U]

[51] Int. Cl.[3] ..... D04B 9/02; D04B 15/66

[52] U.S. Cl. ..... 66/8; 66/239

[58] Field of Search ..... 66/8, 231, 239

[56] References Cited

U.S. PATENT DOCUMENTS 4,151,729 5/1979 Micheletti ..... 66/231 X 4,221,120 9/1980 Farmer ..... 66/8 X 4,267,708 5/1981 Chietti ..... 66/239 X

FOREIGN PATENT DOCUMENTS 2739051 3/1978 Fed. Rep. of Germany ..... 66/231

*Primary Examiner*—Wm. Carter Reynolds

*Attorney, Agent, or Firm*—McGlew and Tuttle

[57] ABSTRACT

A circular knitting machine comprises a base framework and a frame forming a seat for a rotatable assembly of the needle cylinder and a support for other members connected therewith. The frame is constituted by a single block with its surfaces machined by lathe-turning to form internal seats for the bearings of the rotatable assembly and external seats for a cam drum and a program drum.

2 Claims, 3 Drawing Figures

33A
33
88
32
86
26
82
30
90
28
80
34
92
37
36
16
18
7A
42
94
78
10
24
14
78
56
82
76
13
44
84
62
26
IV
7
IV
58
9
60
64
58A
66
68
48
70
72
72
52
3
74
52A
5
22
12
54
50
1
46
38

CIRCULAR KNITTING MACHINES

FIELD OF THE INVENTION

The invention relates to circular knitting machines, for example for knitting stockings, and in particular to the support structure for the needle cylinder and the members combined and co-operating with it, that is the frame.

SUMMARY OF THE INVENTION

According to the invention there is provided in a circular knitting machine, a rotatable assembly including a needle cylinder, a cam drum, a program drum, bearings for the rotatable assembly, and a support defining a seat for the rotatable assembly, said support comprising a single block having a surface machined by lathe-turning to form internal seats for the bearings of the rotatable assembly, and external seats for the cam drum and program drum.

The external seats can be constituted by two cylindrical zones, which center at least one cylindrical skirt for the cams.

A cylindrical surface towards the base can be provided for insertion into a lathe-turned seat in an underlying framework.

The body can advantageously comprise two annular flanges machined over opposite surfaces—in particular flat surfaces—for mounting a plurality of members connected with the cylinder, with the cam drum and with the program drum.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENT

Figure 1:
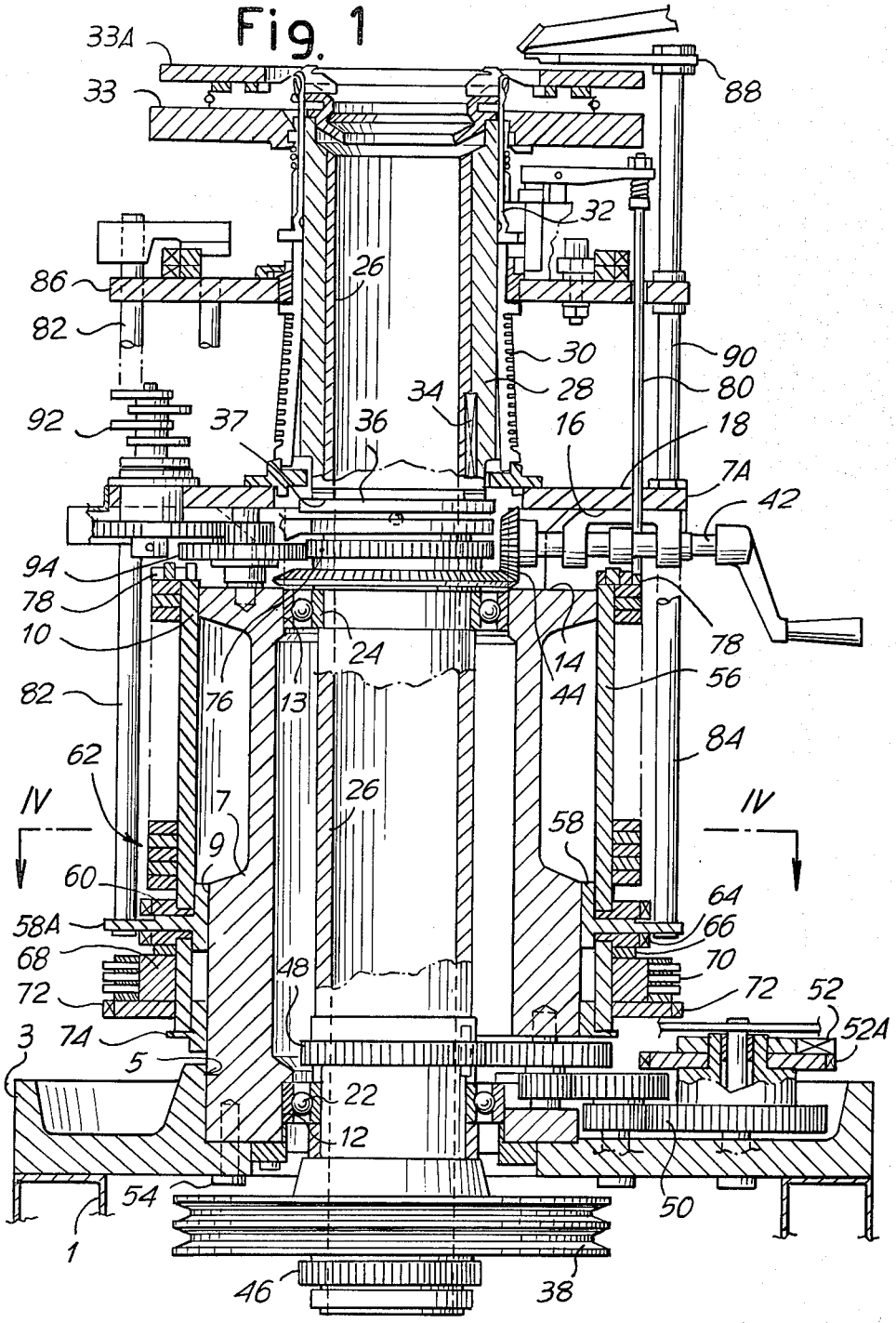
FIG. 1 is a section through a circular knitting machine in a plane passing through the axis of the needle cylinder.
Figure 2:
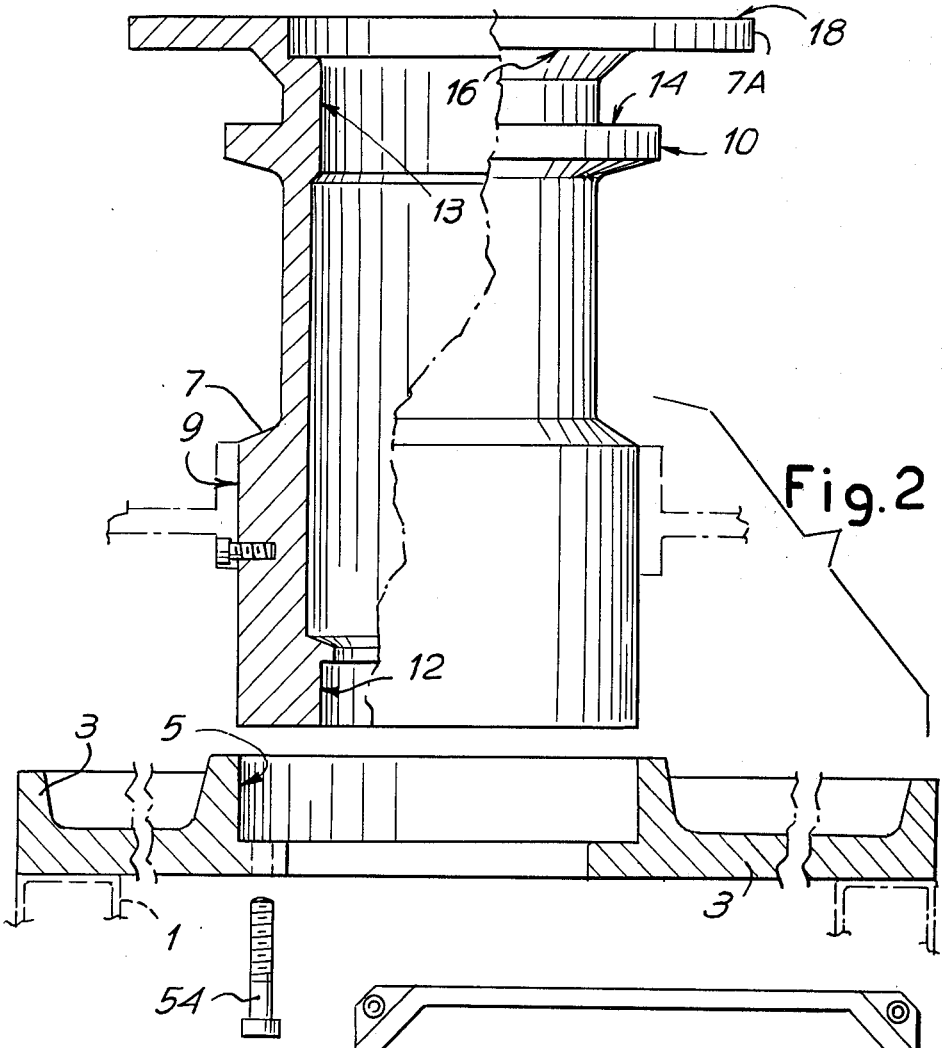
FIGS. 2 and 3 are respectively an axial section through a lathe-turned block which forms a frame for supporting the needle cylinder, and a plan view of a base plate for the frame.
Figure 3:
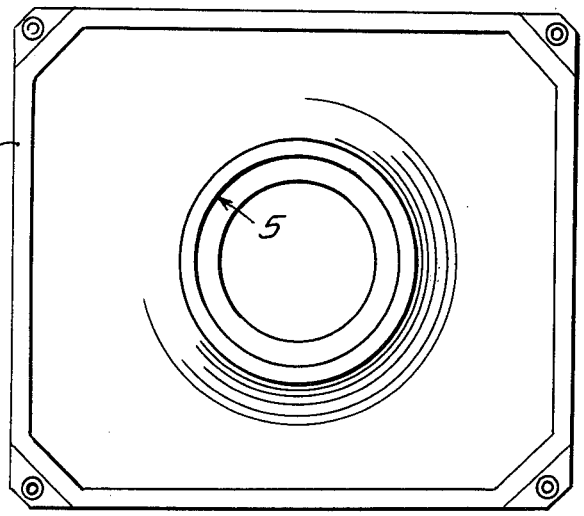

As shown in the drawings, a plate 3 is mounted on a base framework 1 and comprises a cylindrical lathe-turned seat 5 in which is inserted a supporting body 7 to act as the frame for supporting the needle cylinder and the mechanisms adjacent to it. The body 7 is in the form of a body of revolution, and in particular (see FIG. 2) it comprises a single block having a series of lathe-turned external cylindrical surfaces 9, 10 and internal cylindrical surfaces 12, 13, together with transverse lathe-turned flat surfaces, 14, 16 and 18. The surface 10 is formed on an annular flange. The machined surfaces 9, 10, 14, 16 and 18 form external seats or support areas for various parts to be described and the surfaces 12 and 13 form internal seats for other parts to be described. The surfaces 12 and 13 receive bearings 22 and 24 for a tubular member 26, the upper part of which carries the needle cylinder 28, which is provided with the usual longitudinal slots for the jacks 30 and needles 32. A sinker ring 33 is rigid with the cylinder 28, and lies below a sinker cover 33A which carries the control cams for the sinkers.

The cylinder 28 is slidably but not rotatably coupled to the tubular member 26 by means of a key 34. At the lower end of the cylinder 28 there is provided a flange 36 with an underlying thrust bearing 37, for controlling the vertical movements of the needle cylinder in order to vary the stitch, and consequently for contracting and lengthening the stitches in a conventional manner by means of a suitable control system described hereinafter. The needle cylinder is rotated by the tubular member 26, which is controlled by a belt transmission of which the pulley which is rigid with the lower end of the member 26 is indicated by 38. A manual control system for rotating the cylinder is provided by way of a radial shaft 42 and a bevel gear coupled between said shaft 42 and the member 26. Ring gears such as 46, 48, and 76 are rigid with the tubular member 26. The ring gear 48 drives a reduction gear unit 50 which rotates—with a ratio of 4:1 or similar—a cam system 52 for intermittently advancing a program drum and a cam drum, which are coaxial with the tubular member 26 and consequently with the needle cylinder 28.

The ring gear 76 drives a welt dial and yarn cutting knife, and also—when necessary—drives by way of two gears 94 two selection devices 92 which act on jack selection levers 30. The ring gear 46 drives the gear for any required anti-twist.

The body 7 forming the frame comprises at its top a disc-like annular flange 7A, the flat surfaces 16 and 18 of which are machined, as stated. Another annular flange of body 7 carries surfaces 10 and 14. Surfaces 16 and 14 thus from facing component mounting surfaces. The body 7 is held in the seat 5 of the plate 3, and is locked therein by means of a set of bolts 54 after mounting a plurality of members constituting the program drum and cam drum. The cam drum comprises a cylindrical skirt or shell 56, which is directly mounted on the surface 10 and underneath the flange 7A, and indirectly on the surface 9 by way of a centering and support element 58 comprising a flange 58A.

A ring gear 60 with relatively long ratchet teeth is also engaged between the member 58, 58A and the skirt 56 to form a toothed wheel for driving the cam drum of which the skirt 56 forms part. On the skirt 56 there is provided a set of cam tracks, each of which, and in particular those indicated by 62, are cam tracks for controlling the stitch adjustment, one for each of the phases in which this adjustment is provided, and thus for controlling the vertical movements of the needle cylinder 28. Below the flange 58A there is mounted a second ring gear 64 with relatively long ratchet teeth, to constitute a rapid advancement ring gear for the return of a program drum 68. The two ring gears 60 and 64 can for example each comprise 24 teeth. Below the ring gear 64 there is disposed a cam track 66 which can be designed for gradually contracting the stitch at the ankle of a ladies stocking to be made by the machine. Further below the ring gear 64 there is mounted the program drum 68 in which circumferential rows of bores are provided for the selective insertion of pins or rollers 70 intended to replace the controls normally operated by the program chain in conventional knitting machines. The drum 66 is controlled by a ring gear 72 provided with a plurality of ratchet teeth which are much shorter than those of the ring gears 60 and 64, and for example provided with two hundred and eighty-eight teeth, corresponding to the radial bore seats for the pins or rollers 70. The bore tracks for the pins or rollers can for example be seven or more in number, for controlling, in the order stated, the return system, the cam drum, the speed, and other control requirements which can be necessary for particular machine operations. Pawls, not shown, co-operate with the ring gears 60, 64 and 72. The cam drum 56 and program drum 68 move stepwise intermittently independently of each other, the program drum 68 being retained by a ring 74 below the member 58, 58A. The ring 74 on the surface 9 is provided with screws for fixing to the member 7, the screws extending mostly radially.

Between the flange 58A of the member 58 (mounted on and fixed to the surface 9 of the body 7) and the terminal flange 7A of the body 7, there are mounted spindles such as 82 and 84, having their axis parallel to the axis of the needle cylinder 28 and member 26, for followers for the cams of the cam drum 56, for operating the selection and control members for the needles and yarn guides in a skirt for cams or for other equivalent members, which is disposed above the flange 7A, on the surface 18 alone in the case of a simpler embodiment, whereas in the case of a more complicated embodiment a second platform 86 is also provided surrounding the needle cylinder, as in the case of the flange 7A, and carrying further control members combined with the needle cyclinder. A further annular structure 88 is held on the columns 90 which support the platform 86, or on independent columns, for further members co-operating with the needle cylinder, such as the supports for the yarn guides and the like, all as in a conventional arrangement.

Other rods 80 raised by axial cams 78 on the drum 56 provide control actions on the cams of the hooks or the stitch or for other uses. The reference numeral 92 indicates generally one of the selection devices for controlling the levers which act on the jacks such as those indicated by 30 for selecting the needles for forming the mesh, in a completely conventional manner, the rotational movement being taken from the member 26 by way of a transmission 94 from the ring gear 76 held at a level between the surface 14 and surface 16 and on member 26, as in the case of the shaft 42 and transmission 44 already described. The space between the surfaces 14 and 16 also holds the system for controlling the vertical movements of the cylinder 28 by way of the flange 36, for contracting and lengthening the stitches.

With the described construction of the body or frame 7, machining operations are simplified, production is made economical, and it is relatively easy to attain substantial machining precision.

What is claimed is:

1. In a circular knitting machine having a rotatable assembly (26) including a needle cylinder (28), a cam drum (56), a program drum (68), and a pair of bearings (24, 22) for rotatably supporting the rotatable assembly, the improvement comprising a single hollow supporting body (7) having: an upper annular flange (*7a*) with a top lathe-turned radially extending surface (18) and a bottom lathe-turned radially extending surface (16); a lower annular flange with top radially extending lathe-turned surface (14) spaced from and facing said upper flange bottom surface (16) to form therewith facing component-mounting surfaces, and a first outer cylindrical lathe-turned surface (10), a second outer cylindrical lathe-turned surface (9) on said supporting body spaced below said outer cylindrical surface (10) and adjacent a lower end of said body; a centering element (58) mounted over said second outer cylindrical surface (9); a first inner lathe-turned cylindrical surface (13) defined on an interior of said body adjacent a top end thereof; and a second inner lathe-turned cylindrical surface (12) defined on the interior of said body adjacent the lower end thereof; one of the pair of rotatable assembly bearings connected between the rotatable assembly and each of said first and second inner cylindrical surfaces with the needle cylinder extending upwardly of said first inner cylindrical surface; the cam lathe-turned mounted on said first outer cylindrical surface (10) and said centering element (58) at respective upper and lower ends of the cam drum; a ring (74) on said second outer cylindrical surface (9); the program drum mounted under said centering element (58) and over said ring (74).

2. A knitting machine according to claim 1, further comprising a base plate (3) having a lathe-turned seat (5), said supporting body second outer cylindrical surface received in said seat of said base plate.

* * * * *